US005987795A

United States Patent [19]

Wilson

[11] Patent Number: 5,987,795

[45] Date of Patent: Nov. 23, 1999

[54] PAPER SLIP HOLDING FILE CARD

[76] Inventor: Paul A. Wilson, 1935 Santa Fe, Del Mar, Calif. 92014

[21] Appl. No.: 08/948,555

[22] Filed: Oct. 10, 1997

[51] Int. Cl.[6] ..... A47B 49/00

[52] U.S. Cl. ..... 40/658; 24/562; 24/563; 40/377; 40/373

[58] Field of Search ..... 40/372, 373, 377, 40/378, 379, 652, 658, 661.08, 666; 24/67.1, 545, 555, 562, 563

[56] References Cited

U.S. PATENT DOCUMENTS

| | | | |
|---|---|---|---|
| 521,259 | 6/1894 | Davis | 24/562 |
| 1,399,673 | 12/1921 | Van Amber | 40/658 |
| 5,617,982 | 4/1997 | Wilson | 224/411 |

*Primary Examiner*—Cassandra H. Davis
*Attorney, Agent, or Firm*—Baker & Maxham

[57] ABSTRACT

A file card for a paper slip holder and dispensing unit comprises a substantially flat stiff support panel having a generally rectangular configuration, a front face, a back face, a top edge and a bottom edge, a mounting attachment at the bottom edge for mounting on a support shaft, and a coupon clip on the front and back faces, the clip formed of a substantially rectangular sheet of semi-rigid material having a fixed end and a free end, the fixed end secured to the support panel adjacent an edge thereof, the sheet formed with a rounded fold along a transverse line forming a long panel and a short panel having a common edge, the short panel having the free end, the short panel disposed adjacent the face of the support panel, and the free edge of the short panel curved toward the face of the support panel.

18 Claims, 2 Drawing Sheets

PAPER SLIP HOLDING FILE CARD

BACKGROUND OF THE INVENTION

1. Field of the Invention

The present invention relates to file cards and pertains particularly to a file card having improved clip means for holding paper slips and the like.

2. Description of the Related Art

In my prior patent U.S. Pat. No. 5,501,383 I disclose a coupon organizing and dispensing apparatus for shoppers to use in a supermarket or similar store environment. The dispensing apparatus includes an elongated housing or frame which houses a coupon holder. The coupon holder includes a rotary mechanism to which coupon file cards are removably mounted. The rotary mechanism is made up of a shaft journaled to the frame and having knobs disposed at each end for manually rotating the shaft. Circumferential rods or rails spaced apart along the shaft extend around the shaft and are adapted to removably hold the coupon file cards. The file cards are capable of removably holding store discount coupons in a fixed position.

When the shaft is turned by manually rotating the knobs, the shaft operates to sequentially present coupon file cards containing coupons for the shopper to visually inspect, remove and redeem for a purchased item to be discounted by the coupon's stated amount. Alternatively, the coupon file cards may be mounted in the housing in other suitable ways. The coupon apparatus also includes a calculator for the shopper's use and a storage bin to hold coupons selected for redemption.

The housing is formed with a lower notch or hook adapted to engage and hook to a handle of a shopping cart. The notch is also capable of serving as a carrying handle for when the apparatus is being transported by the shopper. The file cards have a clip on one face and are capable of removably holding store discount coupons, or other similar paper slips, in a fixed position. While that apparatus was designed primarily to hold store discount coupons, it is useable to hold many other slips of paper such as business cards, receipts, recipes, tickets and many other articles in the form of slips of paper or the like.

The clip as originally illustrated in the patent proved to be unsatisfactory in that it could not consistently and reliably hold paper slips. A further design as illustrated in FIG. 1 also proved unsatisfactory for other reasons. In that design a card 10 of somewhat rigid material has a strip, or overlay of semi-rigid material which is folded over with a hard or sharp crease 12 forming two panels. The crease is positioned off center forming a long panel 14 and a short panel 16 which together form the clip. The long panel is formed with a free edge 18 secured along an outer edge of card 10. The short panel has a free edge 20 extending toward the card 10 forming a gripping edge of the clip. The free edge is pressed toward the card surface with enough force to removeably hold one or more sheets of paper or cardboard.

However, the design has some drawbacks. One problem encountered was that the gripping edge 20 would occasionally hang up on the slip or coupon being pulled and be pulled out from under the longer panel distending the short panel rendering it non-functional. It required pushing back into its original position to again become functional. Another problem with that design was its inability to hold multiple slips of thin material such as paper. Even though several slips could be inserted fully under the clip, the combined thickness caused them to engage the underside of the longer panel pushing it out and preventing the short panel exerting sufficient force to hold the multiple slips. Accordingly, it is desirable that a clip for a paper slip holding card be available that is reliable and effective to hold multiple coupons or other similar paper slips.

SUMMARY AND OBJECTS OF THE INVENTION

It is the primary object of the present invention to provide a paper slip holding file card having a clip that is reliable and effective to hold multiple coupons or similar paper slips.

A paper slip holding file card for a paper slip holder and dispensing unit, said card comprises a substantially flat stiff support panel having a generally rectangular configuration, a front face, a back face, a top edge and a bottom edge, mounting means at said bottom edge for mounting said card on support means, and a paper slip holding clip on at least one of said front and back face, said clip comprising a substantially rectangular sheet of semi-rigid material having a fixed end and a free end, the fixed end secured to said support panel adjacent an edge thereof, said sheet formed with a rounded fold along a transverse line forming a long panel and a short panel having a common edge, said short panel having said free edge, said short panel disposed adjacent said face of said support panel, and said free edge of said short panel curved toward said face of said support panel.

BRIEF DESCRIPTION OF THE DRAWINGS

The above and other objects and advantages will become apparent from the following detailed description, when read in conjunction with the accompanying drawing, wherein.

DETAILED DESCRIPTION OF THE PREFERRED EMBODIMENTS

Figure 1:
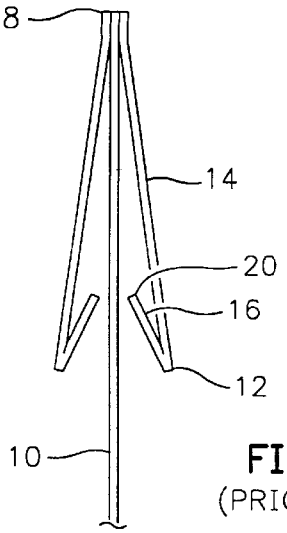
FIG. 1 (PRIOR ART)
FIG. 1 is a side elevation view of a prior art paper slip holding file card clip.
Figure 2:
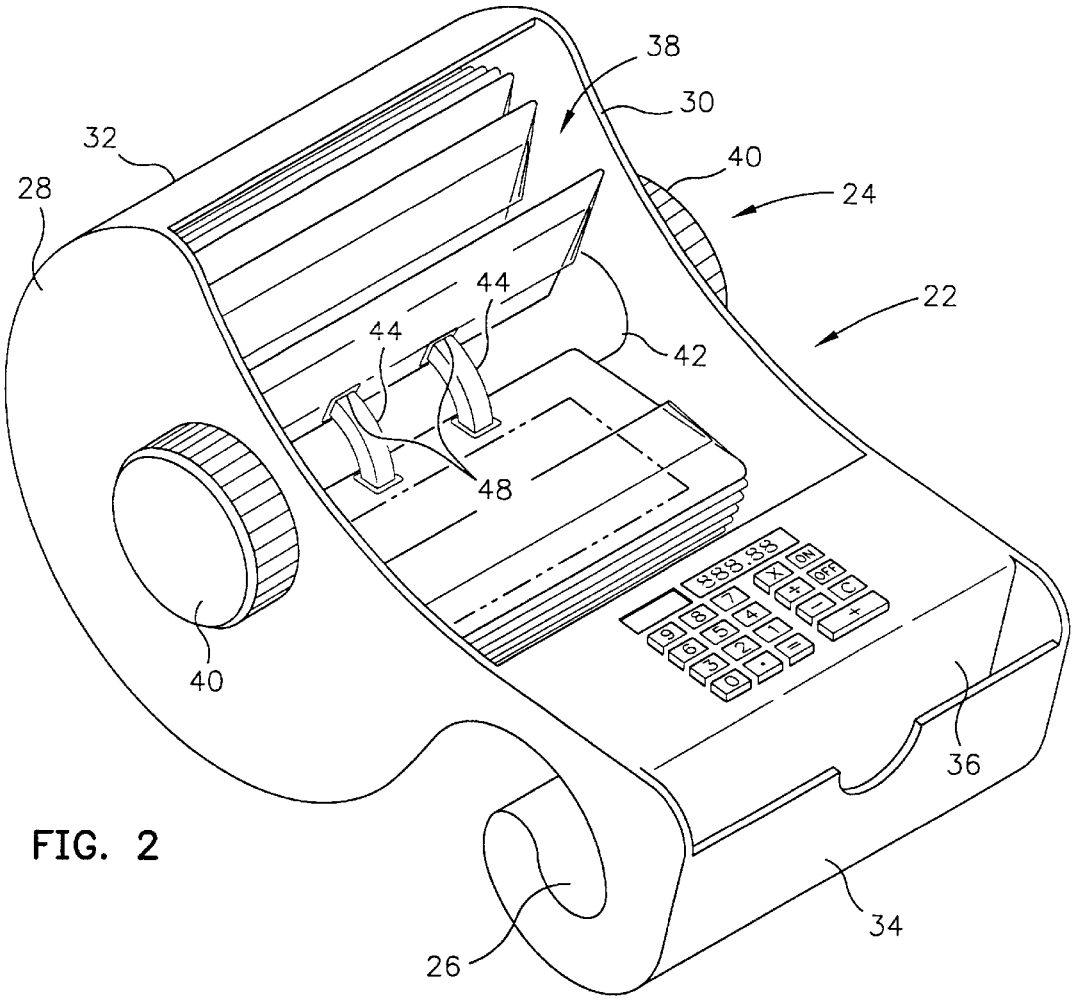
FIG. 2 is a perspective view of a coupon holding and dispensing apparatus embodying file cards in accordance with a preferred embodiment of the invention.

Referring now to FIG. 2, a rotary store coupon holder and dispensing apparatus designated generally at 22 which includes paper slip holding file care designated generally at 24 disposed in an elongated open top or front housing is illustrated. The housing has notch or hook 26 formed at one end adapted to engage and hook or attach to the handle of a shopping cart. The notch 26 may also serve as a carrying handle to enable the apparatus to be easily carried by the user. The frame is composed of spaced parallel sides 28 and 30 having a curved sheet or panel 32 secured between them. The curved sheet 32 is of stiff material and preferably extends from the top, around the bottom, around and through notch 26, ending in rear external wall 34 and forming a card or coupon cavity 36.

Coupon holder 22 incorporates a rotary mechanism designated generally at 38 which includes external knobs 40 and central shaft 42. The central shaft is provided with spaced circumferentially disposed or extending rails 44 for rescissably holding or mounting file cards. The knobs 40 enable hand rotation of the shaft for positioning file cards for selection. The central shaft 42 may also be referred to as a drum and is journaled in a conventional manner in sidewalls 28 and 30. Rails 44 are adapted to removably slidably engage and mount file cards 46 in a conventional manner. The card is formed with two slots 48 at the bottom edge for releasably engaging the rails 44. The cards could be releasably and pivotally attached to the shaft in any suitable manner. When the shaft is rotated different file cards sequentially come into position to reveal coupons for selection by the user. A variety of techniques for securing a paper slip to a file card were initially envisioned. It will also be appreciated that the file card of the present invention may be used with any number and kind of different card holders for holding any number of different slips of paper and the like.

Figure 3:
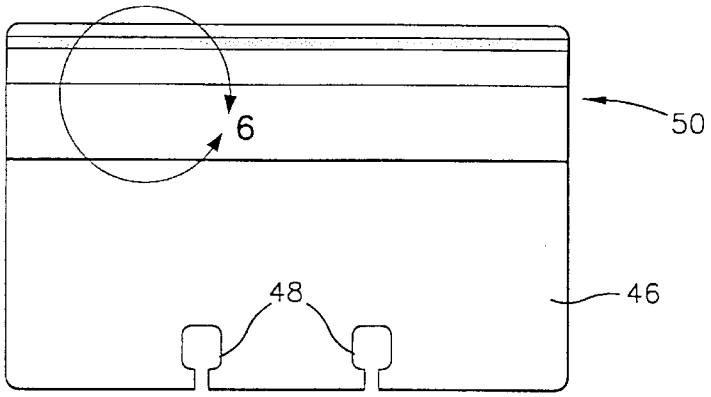
FIG. 3 is a front elevation view of the file card of FIG. 2.
Figure 4:
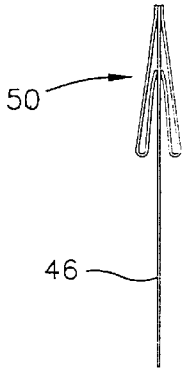
FIG. 4 is a side elevation view of the file card of FIG. 3.
Figure 5:
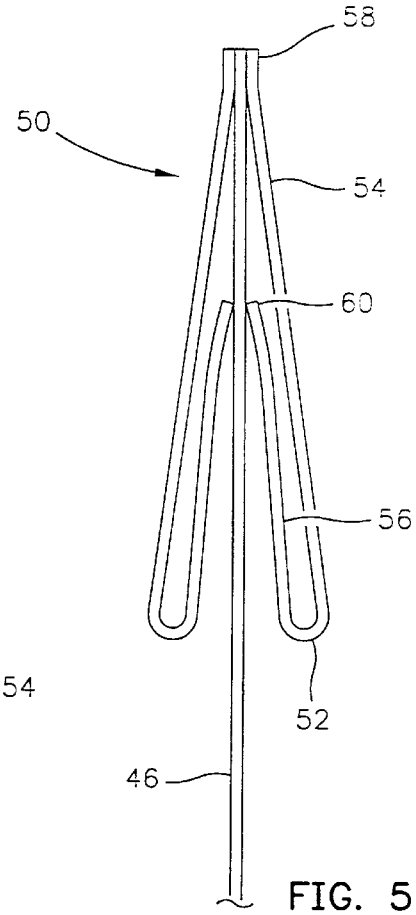
FIG. 5 is an enlarged detailed side elevation view of the file card clip of FIG. 3.

The present invention provides an improved file card and clip that overcome the previously discussed and other problems of the prior art. Referring to FIGS. 3–5, a file card 46 having at least one clip designated generally at 50 for securing one or more slips of paper or other thin material is secured in a fixed position on at least one side of the card. There could also be two or more such clips at spaced intervals on each side of the card. Referring to FIGS. 4 and 5, the file card 46 is illustrated as having one clip 50 on each side of the card which would enable slips of paper to be removably secured to each side of the file card. The clips are illustrated as being at the top edge of the file card, but may also be positioned on or along a side or the bottom.

The card 46 may be constructed of cardboard, plastic or any other suitable material. The clip 50 may be constructed of a semi-rigid flexible material such as polypropylene or any other suitable plastic. The file card and clip may also be formed of the same material and formed of a unitary construction.

In a preferred embodiment, the clip is formed of a generally rectangular sheet of polypropylene folded with a soft or rounded crease along a transverse line at 52 dividing the sheet into a long panel 54 and a short panel 56. The crease is rounded rather than sharp and preferably has a radius of curvature from about two to about six times the thickness of the panel. The as illustrated in FIG. 5, the crease or fold is uniformly rounded or symmetrical with respect to a plane lying parallel to the panels. This more rounded crease enables the shorter panel 56 to extend slightly toward and lie closer at its free end to the long panel 54. This forms a long panel having a free end or edge 58 (which becomes fixed upon mounting) and a short panel having a free end or edge 60 and both panels sharing a common end at the fold or crease. The free or outer end 58 of the long panel is secured by appropriate means such as an adhesive to a face of the file card 46 at the top or outer edge thereof along a line or strip 64 as shown in FIG. 3. It is positioned and secured with the short panel disposed adjacent the face of the file card.

The short panel 56 lies beneath the long panel adjacent the file card with a free end 60 curved toward the face of the file card and defining a gripping edge. It has a length of about 40% to about 70% of the long panel and extends with the gripping edge within this range, preferably to about the mid point or beyond of the long panel. This makes the short panel long enough that it will not be pulled from beneath the long panel. The panel 56 extends substantially parallel to the surface of the file card for most of its length before curving away from panel 54 and toward the file card at the outer free end. This gives it a large surface area to contact and hold a slip of paper or other thin material. The curved end or edge of the short panel may curve inward toward the file card at an angle of from about five degrees to about fifteen degrees. This curved edge can be formed by the cutting process in forming the panels from larger sheet or roll stock. The edge 60 may engage or be slightly spaced from the surface of the file card. In any event it will be sufficiently close to engage the surface of a thin slip of paper or other material inserted into the space between them. The sheet will be selected to have sufficient stiffness to bias the gripping edge with sufficient force to hold a slip of paper or the like engaged by it.

Figure 6:
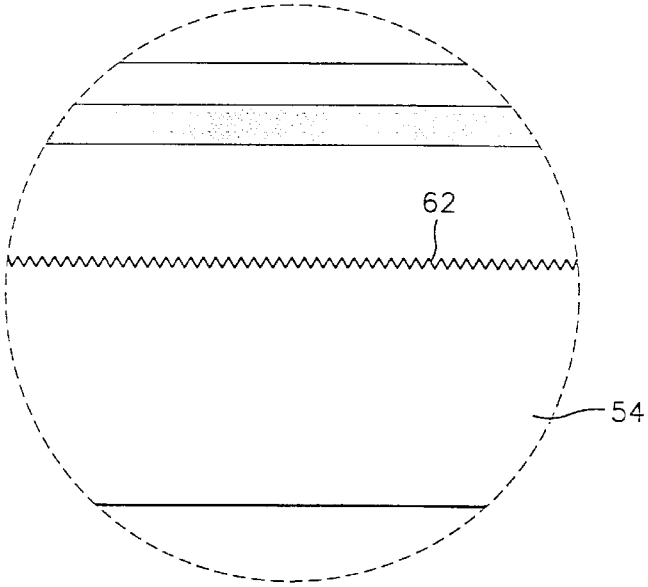
FIG. 6 is an enlarged detailed front elevation view of a portion of the file card clip of FIG. 3.

As seen in FIG. 6, the end or edge 60 of the short panel is preferably formed as a serrated edge forming gripping teeth or points 62 which engage and grip a sheet placed under the panel. This form of edge provides a positive grip of the surface of slips of paper engaged by it. The edge 60 will preferably be positioned in engagement with the face of the file card. In any event it will be spaced less than the expected thickness of a slip to be engaged by it.

It will be appreciated that while the present invention was devised as a coupon file card, it may be used for holding any number of other slips of paper including business cards, photographs, receipts, tickets, recipes, and the like. It will also be appreciated that the file cards may be used in any suitable card holder of any type for holding any number of small paper or other slips.

In operation, slips to be stored will be inserted between panel 56 and the face of file card 46 until its upper edge extends beyond the gripping edge 60. The uppermost slip will be engaged by the edge 60 retaining it in place. The clip has sufficient stiffness to clamp and hold one or more slips against falling out.

While I have illustrated and described my invention by means of specific embodiments, it is to be understood that numerous changes and modifications may be made therein without departing from the spirit and the scope of the invention as defined in the appended claims.

What is claimed is:

1. A file card for a slip holder and dispensing unit, said card comprising:

a substantially flat stiff support panel having a generally rectangular configuration, a front face, a back face, a top edge and a bottom edge;

mounting means at said bottom edge for mounting said card on support means; and a clip on at least one of said front and back face, said clip comprising a substantially retangular sheet of semi-rigid material having a fixed end and a free end secured to said support panel adjacent said top edge thereof, said sheet formed with a rounded fold along a transverse line forming a long panel and a short panel having a common edge, said short panel having a free edge, said short panel disposed adjacent said one of said front and back face of said support panel, and said free edge of said short panel being curved toward and in engagement with said one face of said support panel defining a gripping edge for engaging and gripping sheets against said one face of said panel.

2. The file card of claim 1, wherein said gripping edge of said short panel is formed with gripping teeth.

3. The file card of claim 1, wherein said gripping edge is serrated forming gripping teeth and wherein said gripping edge extends at an angle of between about five and fifteen degrees with respect to said long panel.

4. The file card of claim 1, wherein said clip is integral with said support panel.

5. The file card of claim 1, wherein said support panel includes multiple ones of said clip.

6. The file card of claim 5, wherein one of said clip is on each face of said support panel.

7. The file card of claim 1, wherein said clip is secured adjacent said top edge of said support panel.

8. The file card of claim 7, wherein said short panel is about one half the length of said support panel.

9. The file card of claim 1, wherein said short panel is about one half the length of said support panel.

10. The file card of claim 9, wherein said free end extends at an angle of between about five and fifteen degrees with respect to said long panel.

11. The file card of claim 10, wherein said clip is secured adjacent said top edge of said support panel.

12. A file card for a paper slip holder and dispensing unit, said card comprising:

a flat stiff support panel having a substantially rectangular configuration, a front face, a back face, a top edge and a bottom edge;

mounting means at said bottom edge for mounting said card on support means; and a paper slip clip on at least said front face, said clip comprising a substantially rectangular sheet of semi-rigid material having at fixed end and a free end, the fixed end secured to said support panel adjacent said top edge thereof, said sheet folded with a symmetrically rounded fold along a transverse line forming a long panel and a short panel having a common edge, said short panel extending substantially parallel to said long panel and having a free edge, said short panel being disposed adjacent to and substantially parallel to said front face of said support panel, and said free edge of said short panel being curved toward and engaging said front face of said support panel defining a gripping edge for engaging and gripping sheets against said front face of said support panel.

13. The file card of claim 12, wherein said short panel is about one half the length of said support panel.

14. The file card of claim 13, wherein said free end extends at an angle of between about five and fifteen degrees.

15. The file card of claim 14, wherein said gripping edge is serrated forming gripping teeth.

16. The file card of claim 12, wherein said gripping edge is serrated forming gripping teeth.

17. The file card of claim 12, wherein said sheet is formed of polypropylene.

18. A file card for a paper slip holder and dispensing unit, said file card comprising:

a flat stiff support panel having a substantially rectangular configuration, a front face, a back face, a top edge and a bottom edge;

mounting means at said bottom edge for mounting said card on support means; and a paper clip mounted on said front face, said clip comprising a substantially rectangular sheet of polypropylene material having a fixed end and a free end, the fixed end secured to said support panel adjacent said top edge thereof, said sheet folded with a symmetrically rounded fold along a transverse line forming a long panel and a short panel having a common edge, said short panel having a length about one-half the length of said long panel and extending substantially parallel to said long panel and having a free edge, said short panel disposed adjacent to and substantially parallel to said front face of said support panel, and said free edge of said short panel being formed with teeth and curved toward said front face of said support panel at an angle of from about five to about fifteen degrees defining a gripping edge engaging said front face for engaging and gripping sheets against said front face of said support panel.

* * * * *